US009293089B2

(12) United States Patent
Derckx et al.

(10) Patent No.: US 9,293,089 B2
(45) Date of Patent: Mar. 22, 2016

(54) DISPLAY DRIVING METHOD

(71) Applicant: Amazon Technologies, Inc., Seattle, WA (US)

(72) Inventors: Henricus Petronella Maria Derckx, Weert (NL); Jozef Elisabeth Aubert, Roermond (NL); Johannes Wilhelmus Hendrikus Mennen, Budel (NL)

(73) Assignee: Amazon Technologies, Inc., Seattle, WA (US)

( * ) Notice: Subject to any disclaimer, the term of this patent is extended or adjusted under 35 U.S.C. 154(b) by 115 days.

(21) Appl. No.: 14/137,017

(22) Filed: Dec. 20, 2013

(65) Prior Publication Data

US 2015/0179096 A1 Jun. 25, 2015

(51) Int. Cl.
*G09G 3/34* (2006.01)

(52) U.S. Cl.
CPC ..... *G09G 3/348* (2013.01); *G09G 2300/0452* (2013.01); *G09G 2300/08* (2013.01); *G09G 2310/0256* (2013.01)

(58) Field of Classification Search
CPC ... G09G 3/2813; G09G 3/348; G02B 26/005; G02B 26/004
USPC ..... 345/60, 212
See application file for complete search history.

(56) References Cited

U.S. PATENT DOCUMENTS

| | | | | |
|---|---|---|---|---|
| 6,963,321 | B2 | 11/2005 | Everitt | |
| 2007/0075922 | A1 * | 4/2007 | Jessop | 345/49 |
| 2007/0075941 | A1 * | 4/2007 | Zhou et al. | 345/84 |
| 2011/0187696 | A1 * | 8/2011 | Slack et al. | 345/211 |
| 2012/0154886 | A1 * | 6/2012 | Heikenfeld et al. | 359/228 |
| 2012/0256898 | A1 * | 10/2012 | Aubert et al. | 345/212 |

FOREIGN PATENT DOCUMENTS

| | | | |
|---|---|---|---|
| WO | 2007057797 | A1 | 5/2007 |
| WO | 2008059039 | A1 | 5/2008 |
| WO | 2009004042 | A1 | 1/2009 |

OTHER PUBLICATIONS

Intel Power Management technologies for Processor Graphics, Display, and Memory, White Paper for 2010-2011 Desktop and Notebook Platforms, Aug. 2010.

* cited by examiner

*Primary Examiner* — Viet Pham
(74) *Attorney, Agent, or Firm* — BainwoodHuang

(57) ABSTRACT

A method of driving an electrowetting display device for displaying images. The display device has a plurality of display elements arranged in an active matrix. The matrix has rows and columns. A specific display element is addressed by applying a voltage to the display elements along the column of the specific display element and selecting the row of the specific display element. The method includes determining a first group of rows where the voltages to be applied to the display elements in a predefined column or group of columns are within a first range smaller than a range over which the voltage is controllable; and selecting the rows in the first group consecutively.

22 Claims, 7 Drawing Sheets

| Col. | $\ell$ | $\ell$+1 |
|---|---|---|
| Row k | R | G |
| k+1 | W | B |
| k+2 | R | G |
| k+3 | W | B |

90

| | Col. $\ell$ |
|---|---|
| Row k | |
| k+1 | |
| k+2 | |

91

DISPLAY DRIVING METHOD

BACKGROUND

Electrowetting display apparatuses having a display controller and a display device are known. The display elements of such a display device include two immiscible fluids. The configuration of the fluids can be controlled by applying a voltage to the display element, thereby forming a display effect. When data is input to the display controller, the display elements can be controlled to display the data, for example video images.

It is desirable to reduce the power consumption of the display apparatus.

DETAILED DESCRIPTION

The following detailed description will first describe general driving methods, in which concepts common to various embodiments will be presented. The following detailed embodiments are grouped into four classes, each group setting out features of embodiments for a class. Although the embodiments have been grouped into classes, the techniques and features disclosed for embodiments of one class can generally be included with the embodiments of one or more of the other classes. The improvements the techniques and features provided in embodiments of one class may also be obtained in embodiments of one or more of the other classes.

General Display Driving Methods

Figure 1:
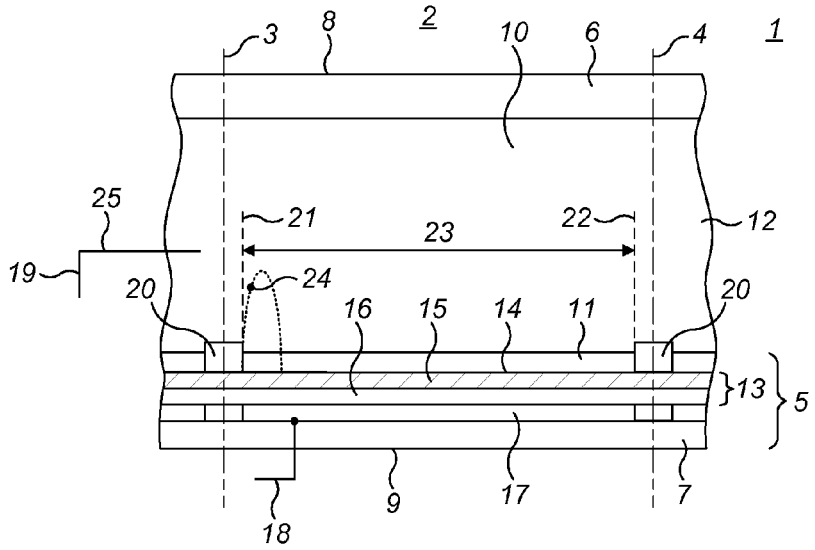
FIG. 1 shows schematically an example display device.

FIG. 1 shows a diagrammatic cross-section of part of an example of an electrowetting device. In this example the device is an electrowetting display device 1 including a plurality of electrowetting cells, which are display elements 2, one of which is shown in the Figure. The lateral extent of the display element is indicated in the Figure by two dashed lines 3, 4. The display elements comprise a first support plate 5 and a second support plate 6. The support plates may be separate parts of each display element, but the support plates may be shared in common by the plurality of display elements. The support plates may include a glass or polymer substrate 6, 7 and may be rigid or flexible.

The display device has a viewing side 8 on which an image or display formed by the display device can be viewed and a rear side 9. In the Figure the first support plate 5 defines the rear side 9 and the second support plate 6 defines the viewing side; alternatively, the first support plate may define the viewing side. The display device may be of the reflective, transmissive or transflective type. The display device may be of a segmented display type in which the image may be built up of segments, each segment including several display elements. The display device may be an active matrix driven display device, a direct drive display device or a passively driven display device. The plurality of display elements may be monochrome. For a colour display device the display elements may be divided in groups, each group having a different colour; alternatively, an individual display element may be able to show different colours.

A space 10 between the support plates is filled with two fluids: a first fluid 11 and a second fluid 12 at least one of which may be a liquid. The second fluid is immiscible with the first fluid. The second fluid is electrically conductive or polar and may be water or a salt solution such as a solution of potassium chloride in water. The second fluid may be transparent, but may instead be coloured, white, absorbing or reflecting. The first fluid is electrically non-conductive and may for instance be an alkane like hexadecane or may be an oil such as silicone oil.

The first fluid absorbs at least a part of the optical spectrum. The first fluid may be transmissive for a part of the optical spectrum, forming a colour filter. For this purpose the first fluid may be coloured by addition of pigment particles or a dye. Alternatively, the first fluid may be black, i.e. absorb substantially all parts of the optical spectrum, or reflecting. A reflective first fluid may reflect the entire visible spectrum, making the layer appear white, or part of it, making it have a colour.

The support plate 5 includes an insulating layer 13. The insulating layer may be transparent or reflective. The insulating layer 13 may extend between walls of a display element. To avoid short circuits between the second fluid 12 and electrodes arranged under the insulating layer, layers of the insulating layer may extend uninterrupted over a plurality of display elements 2, as shown in the Figure. The insulating layer has a surface 14 facing the space 10 of the display element 2. In this example the surface 14 is hydrophobic. The thickness of the insulating layer may be less than 2 micrometers and may be less than 1 micrometer.

The insulating layer may be a hydrophobic layer; alternatively, it may include a hydrophobic layer 15 and a barrier layer 16 with predetermined dielectric properties, the hydrophobic layer 15 facing the space 10, as shown in the Figure. The hydrophobic layer is schematically illustrated in FIG. 1 and may be formed of Teflon® AF1600. The bather layer 16 may have a thickness, taken in a direction perpendicular the plane of the substrate, between 100 nanometers and 150 nanometers and may be made of an inorganic material like silicon oxide or silicon nitride or a stack of these (for example, silicon oxide—silicon nitride—silicon oxide) or an organic material like polyimide or parylene. The barrier layer may comprise multiple layers having different dielectric constants.

The hydrophobic character of the surface 14 causes the first fluid 11 to adhere preferentially to the insulating layer 13, since the first fluid has a higher wettability with respect to the surface of the insulating layer 13 than the second fluid 12. Wettability relates to the relative affinity of a fluid for the surface of a solid. Wettability may be measured by the contact angle between the fluid and the surface of the solid. The contact angle is determined by the difference in surface tension between the fluid and the solid at the fluid-solid boundary. For example, a high difference in surface tension can indicate hydrophobic properties.

Each element 2 includes an electrode 17 as part of the support plate 5. In examples shown there is one such electrode 17 per element. The electrode 17 is separated from the fluids by the insulating layer 13; electrodes of neighbouring display elements are separated by a non-conducting layer. In some examples, further layers may be arranged between the insulating layer 13 and the electrode 17. The electrode 17 can be of any desired shape or form. The electrode 17 of a display element is supplied with voltage signals by a signal line 18, schematically indicated in the Figure. A second signal line 19 is connected to an electrode 25 that is in contact with the conductive second fluid 12. This electrode may be common to all elements, when they are fluidly interconnected by and share the second fluid, uninterrupted by walls. The display element 2 can be controlled by a voltage V applied between the signal lines 18 and 19. The electrodes 17 on the substrate 7 are coupled to a display control apparatus. In a display device having the display elements arranged in a matrix form, that is arranged in rows and columns, the electrodes can be coupled to a matrix of control lines on the substrate 7.

The first fluid 11 in this example is confined to one display element by walls 20 that follow the cross-section of the display element. The cross-section of a display element may have any shape; when the display elements are arranged in a matrix form, the cross-section is usually square or rectangular. Although the walls are shown as structures protruding from the insulating layer 13, they may instead be a surface layer of the support plate that repels the first fluid, such as a hydrophilic or less hydrophobic layer. The walls may extend from the first to the second support plate but may instead extend partly from the first support plate to the second support plate as shown in FIG. 1. The extent of the display element, indicated by the dashed lines 3 and 4, is defined by the centre of the walls 20. The area of the surface 14 between the walls of a display element, indicated by the dashed lines 21 and 22, is called the display area 23, over which a display effect occurs, to be observed from the viewing side 8.

When no voltage is applied, the first fluid 11 forms a layer over the extent of the display area 23 and the display element is in a closed state. When a voltage is applied to the electrodes 17, 25, the first fluid will contract, the contraction being stronger for higher voltages. The display is now in an open state. A fully contracted first fluid is shown in FIG. 1 by reference 24.

The display effect depends on an extent that the first and second fluids adjoin the surface defined by the display area, in dependence on the magnitude of the applied voltage V described above. The magnitude of the applied voltage V therefore determines the configuration of the first and second fluids within the electrowetting cell. When switching the electrowetting cell from one fluid configuration to a different fluid configuration the extent of second fluid adjoining the display area surface may increase or decrease, with the extent of first fluid adjoining the display area surface decreasing or increasing, respectively.

Figure 2:
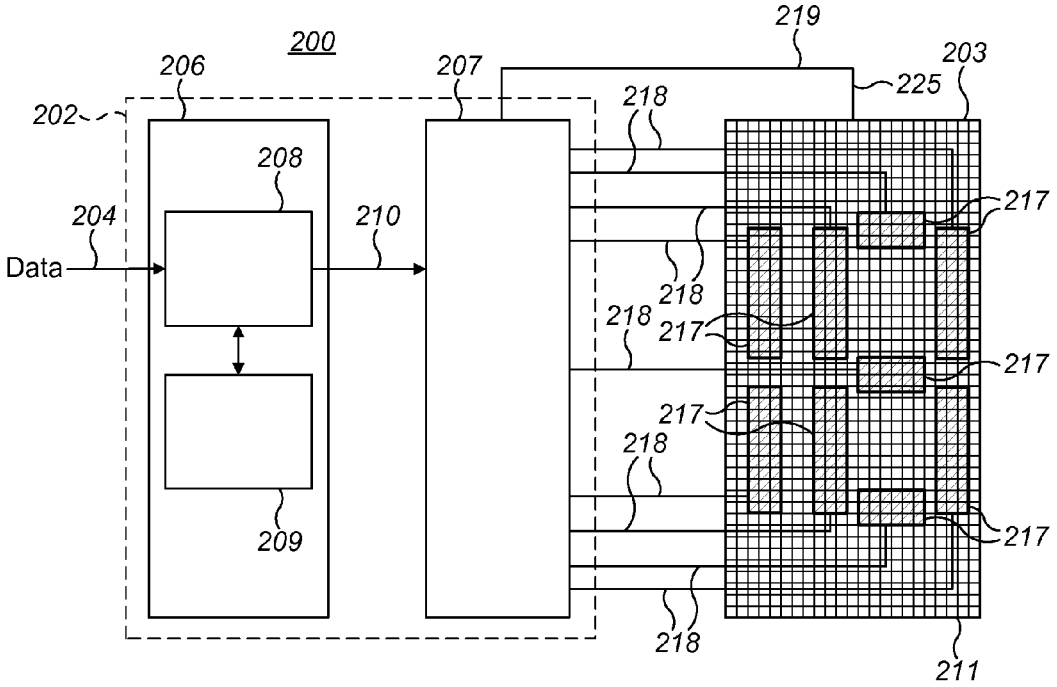
FIG. 2 shows schematically a cross-section of an example display apparatus.

FIG. 2 shows schematically a first example electrowetting display apparatus 201. In this example of a so-called direct drive type, the display apparatus includes a display driving system 202 and a display device 203. Data to be displayed is input via an input line 204 to the display driving system. The display driving system processes the data and outputs signals on signals lines 218 for driving the display device 203. The display driving system 202 includes a display controller 206 and a display driver 207. The display controller includes at least one processor 208 for processing the data entered via the input line 204. The processor is connected to at least one memory 209 which may include computer program instructions configured to, with the at least one memory and the at least one processor, cause the display controller to perform a method according to embodiments described herein. Further, a computer program product comprising a non-transitory computer-readable storage medium may be provided, the computer readable instructions being executable by a computerized device to cause the computerized device to perform a method of driving according to embodiments described herein.

The display controller prepares the data for use in the display device. The output of the processor 208 is connected by line 210 to the display driver 207, which includes driver stages that transform signals to the appropriate voltages for the display device 203. The display driver may also change a serial signal input to it into parallel signals for controlling the voltages on electrodes of the display device 203.

FIG. 2 shows the display device 203 in planar view. The display device includes a plurality of electrowetting cells 211, represented by the small squares of the grid. The electrowetting cells 211 may have the construction of the electrowetting cell as shown schematically in FIG. 1. The lower support plate of the display device 203 includes electrodes 217, which may be separately controllable for each cell, as shown in FIG. 1 or which may be connected for a plurality of cells such that the plurality of cells is driven simultaneously. FIG. 2 shows hatched electrodes 217 that each cover a plurality of cells. An electrode 225 is electrically connected to the shared second fluid of the display device, which in turn is connected by a common signal line 219 to the display driver 207. A display effect can be obtained in each electrowetting cell by controlling the voltage between the electrode 225 and the electrode 217 of that cell.

The display driver 207 and possibly the display controller 206 may be integrated in a circuit that may be mounted on one of the support plates 5, shown in FIG. 1. The electrowetting cells 211 and electrodes 26 in the display device 3 in FIG. 1 constitute a numeric display device for displaying a number from 0 to 19. The numeric display device shown in FIG. 1 is a simple example of a display device of the direct drive type. Many other electrode configurations are feasible, for example to show letters, symbols or images, either in black and white or colour. Each electrode is directly connected to a driver stage (not shown in FIG. 1) in the display driver 7 that controls the voltage on the electrode. The electrodes in the electrowetting cells of the direct drive displays are connected to driver stages all the time during which the electrowetting cells show a display effect. The group of electrowetting cells controlled by one electrode 26 acts as a display element; the constituting electrowetting cells may be called sub-display elements. During the display of a display effect, such as for providing a static or dynamic image, the voltage on each electrode 26 is permanently and simultaneously controlled by the display driver 7.

Figure 3:
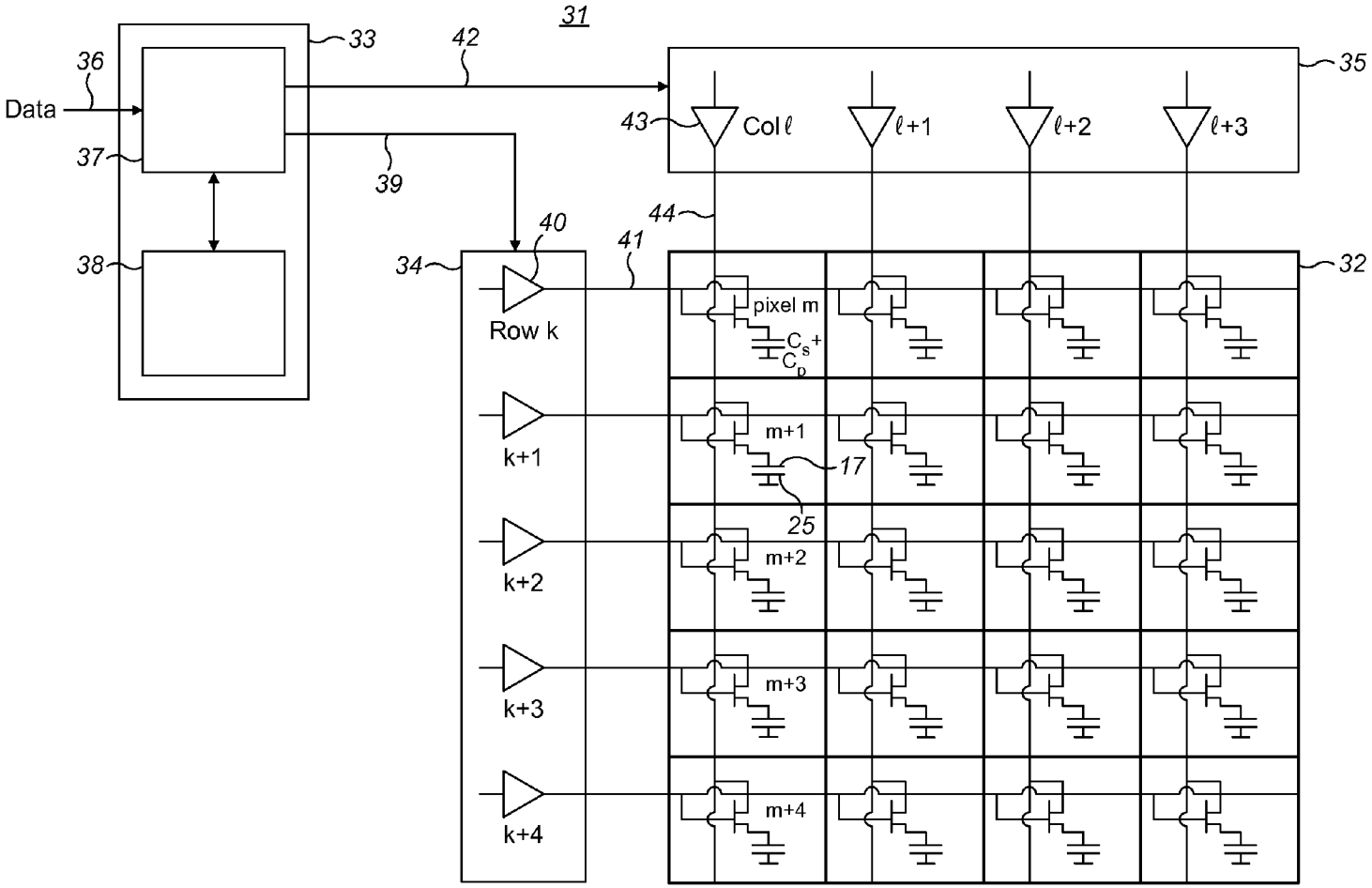
FIG. 3 shows schematically an example display apparatus.

FIG. 3 shows schematically a second example electrowetting display apparatus 31. In this example of a so-called active matrix drive type the display apparatus includes a display driving system and a display device 32. The display driving system includes a display controller 33, a display row driver 34 and a display column driver 35. Data to be displayed is input via an input line 36 to the display driving system. The display controller includes a processor 37 for processing the data entered via the input line 36. The processor is connected to at least one memory 38. The display controller prepares the data for use in the display device.

An output of the processor 37 is connected by line 39 to the display row driver 34, which includes row driver stages 40 that transform signals to the appropriate voltages for the display device 32. Row signal lines 41 connect the row driver stages to rows of the display device 32, providing a row selection signal to each row of the display device.

Another output of the processor 37 is connected by line 42 to the display column driver 35, which includes column driver stages 43 that transform signals to the appropriate voltages for the display device 32. Column signal lines 44 connect the column driver stages to the columns of the display device 32, providing a column signal to each column of the display device.

The display drivers may comprise a distributor, not shown in FIG. 3, for distributing data input to the display driver over a plurality of outputs connected to the driver stages. The distributor may be a shift register. FIG. 3 shows the signal lines only for those columns and rows of the display device that are shown in the Figure. The row drivers may be integrated in a single integrated circuit. Similarly, the column drivers may be integrated in a single integrated circuit. The integrated circuit may include the complete driver assembly. The integrated circuit may be integrated on the support plate 5 or 6 of the display device. The integrated circuit may include the entire display driving system.

The display device 32 comprises a plurality of display elements arranged in a matrix. FIG. 3 shows display elements for five rows, labelled k to k+4 and four columns labelled l to l+3. The total number of rows and columns for common display devices may range between a few hundred and a few thousand. The display elements, also called pixels, of column l are labelled m to m+4. Each display element may have the same construction as the electrowetting cell 20, 21, 22 in FIG. 2.

Each display element of the display device 32 includes an active element in the form of one or more transistors. The transistor may be a thin-film transistor. The transistor operates as a switch. The electrodes of the display element are indicated as a capacitor Cp having electrodes 17 and 25. A line connecting the electrode 25 of the capacitor to ground is the common signal line 19 and the line connecting the electrode 17 of the capacitor to the transistor is the signal line 18 shown in FIG. 1. The display element may include an optional capacitor Cs for storage purposes or for making the duration of the holding state or the voltage applied to the element uniform across the display device. This capacitor is arranged in parallel with Cp and is not separately shown in FIG. 3. The column drivers provide the signal levels corresponding to the input data for the display elements. The row drivers provide the signals for selecting the row of which the elements are to be set in a specific display effect. Selecting a row means putting a signal on the signal line of the row that switches a transistor of the display elements of the row to a closed state. The selection of rows is part of the addressing of display elements in an active matrix display device. A specific display element is addressed by applying a voltage to the column in which the specific display element is located and selecting the row in which the specific display element is located.

When the transistor of a display element receives a pulse on its row selection signal, the transistor becomes conducting and it passes the signal level of its column driver to the electrode 17 of the electrowetting cell. After the transistor has been switched off, the voltage over the cell will be substantially maintained until the transistor is switched on again by the next row selection signal for the display element. The time during which the transistor is switched off is called the holding state of the element. In this active matrix driving method the electrodes of the electrowetting cells are connected to the driving stages briefly at the start of a period during which they show a certain display effect. During this connection, a voltage related to the desired display effect is applied to the electrodes. After an electrowetting cell is disconnected from the driver stage, the voltage on the electrodes is substantially maintained by one or more capacitors during the period during which the electrowetting cell shows the display effect. The method is called 'active', because the display element contains at least one active element, for example a transistor.

Figure 4:
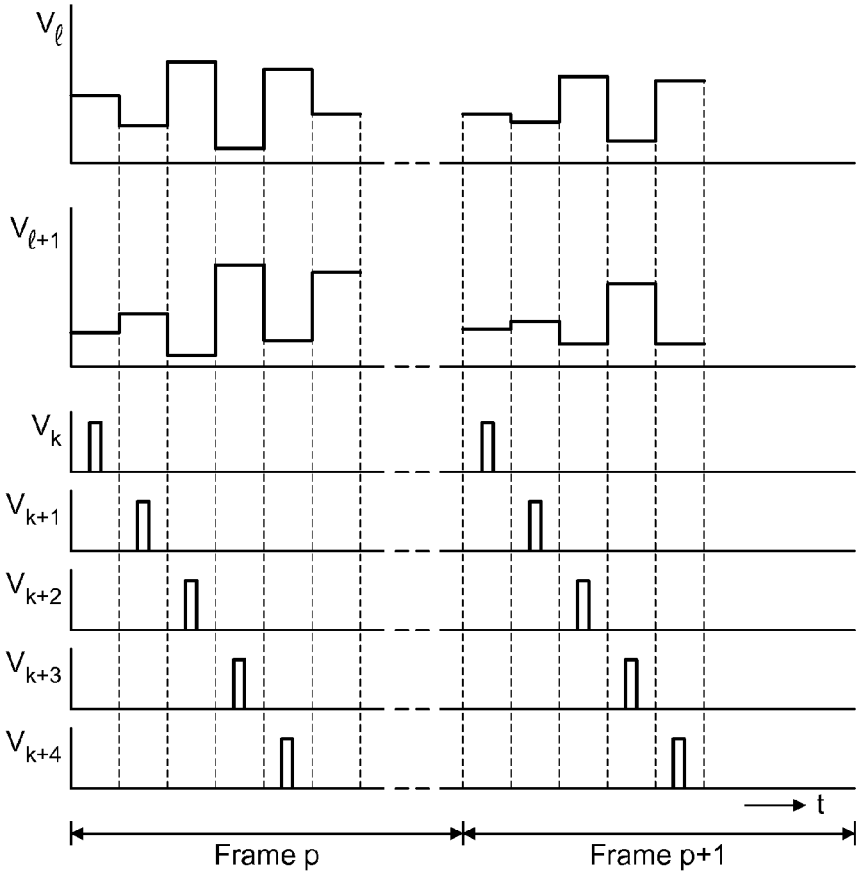
FIG. 4 shows a diagram of an active matrix driving method.

FIG. 4 shows a diagram of an example method of driving the display elements in an active matrix display device. The method displays images during a series of frames, for example, an image is displayed within the duration of one frame. During a frame all display elements of a display device may be addressed; in a matrix all rows of a matrix of a display device are addressed or selected during a frame. FIG. 4 shows two column signals Vl and Vl+1 and five row selection signals Vk . . . Vk+4 as a function of time t for two consecutive frames p and p+1.

When row k is selected by a pulse on row selection signal k, as shown at the start of frame p in FIG. 4, the transistor in each display element of row k becomes conducting and the voltages on each of the column signal lines 44 will be put on the electrode 26 of each display element in row k. Subsequently, the display column driver 35 changes the voltages on the column signal lines to the values required for row k+1. When row k+1 is selected by a pulse on row selection signal k+1, the voltages are put on the electrode 26 of the display elements of row k+1. All rows of the display device will be selected in a similar manner in frame p. The process of selecting the rows starts again in the following frame p+1.

Embodiments of the First Class

The display elements may be controlled by a DC driving scheme, in which all voltages applied to the electrodes 17 and 25 of a display element that are indicative of a display effect shown by the display element have the same polarity over time, i.e. within a frame and in subsequent frames. Such a method is called DC driving, or direct-current driving. Voltages applied to the electrowetting cell that are not indicative of a display effect may have the same or a different polarity as the voltages indicative of a display effect. An example of voltages not indicative of a display effect are voltages that are applied to the electrodes of the display cell for a very short period of time, such that the voltages do not cause a display effect that can be seen by the eye of an observer, such as the voltages used to apply a reset pulse to the display element.

Figure 5:
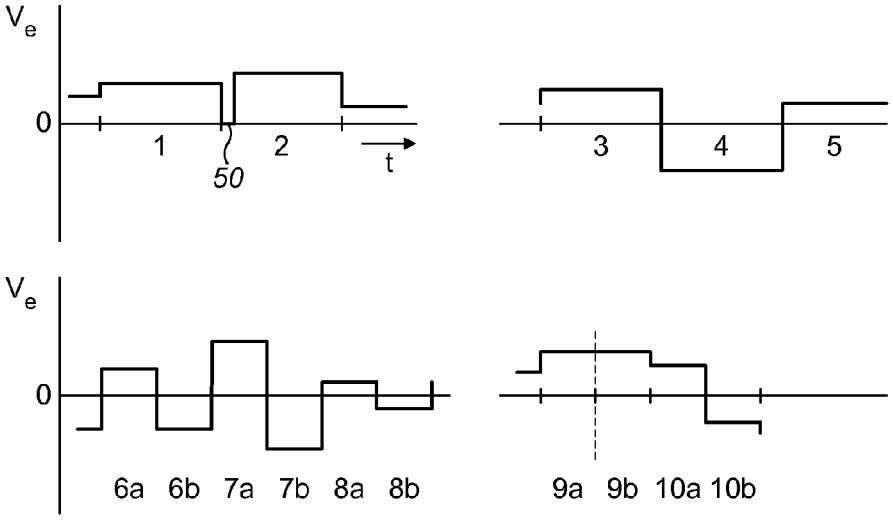
FIG. 5 shows a voltage diagram of a DC-AC driving method.

A reset pulse may be provided to avoid backflow. Backflow is the tendency of the first fluid in the electrowetting cell to flow back to a configuration of a closed state of the display element in spite of a voltage for an open state being applied. A reset pulse may for example reduce the applied voltage to zero for a sufficient duration of time to reduce backflow but still sufficiently short not to provide an observable display effect. FIG. 5 shows an example of use of a reset pulse. It shows a diagram of the voltage Ve between electrode 29 and electrode 26 of an electrowetting cell for several consecutive frames. The frames are numbered along the horizontal axis. The first two frames show DC driving. Frame 1 does not have a reset pulse, frame 2 has a reset pulse 50 at the start of the frame. The reset pulse in this example is a short excursion of the applied voltage to zero. The application of a reset requires two addressing acts within a relatively short period. In an active matrix method a frame will comprise a first subframe to address all display elements and set them to a reset voltage and a second subframe to address all display elements again and set them to the voltage for the required display effect; the first and second subframes are relatively close together because of the short duration of the reset pulse.

When the data input in the display apparatus requires large and frequent changes of the display effect of a DC-driven display element, frames of short duration may be required to avoid blurring. The application of a reset pulse with the extra addressing act combined with the short period frame puts a high demand on the display column driver 35, giving rise to a high power consumption.

Embodiments of the method described below make a selection between a DC driving scheme and an AC driving scheme. However, more drive schemes may be added out of which a selection can be made. Some drive schemes that can be applied simultaneously may be selected together.

In an AC driving scheme the voltages applied to the electrodes of a display element and indicative of a display effect of the display element include at least two voltages having different polarities. Such a scheme may change the polarity of the voltage applied to the electrodes at regular intervals. Since the movement of the first fluid within the electrowetting cell is faster for AC driving than for DC driving, the display element will show a better response to data representing large and frequent changes of the display effect when using AC driving compared with using DC driving.

The reversal of polarity reduces backflow in the electrowetting cell. Hence, reset pulses may be omitted when using this method of driving and the extra addressing act need not be applied. The reduced demand on the display column driver 35 allows the use of shorter frames for improved switching of images with motion.

The above method that can select between DC driving and AC driving may consume less power than a method using AC driving. Although AC driving may properly display both large and frequent changes and small and slow changes of the display effect, AC driving may consume more energy than DC driving. The above method uses AC driving for proper response to large and frequent changes and DC driving for low power consumption during display of small and slow changes.

An AC driving scheme can be implemented as shown in frames 3, 4 and 5 in FIG. 5, where the polarity of the voltage applied changes for each subsequent frame. Another embodiment of AC driving is shown in frames 6 to 8 of FIG. 5. In this embodiment a frame is divided in two subframes, indicated by suffixes a and b; the same voltage level is applied to the electrowetting cell in both subframes, however the polarity changes between the subframes. The display effect will be substantially the same in both subframes, because the display effect is hardly affected by the polarity of the applied voltage. In further embodiments the number of subframes per frame can be increased to 3, 4 or more.

Frames 9 and 10 show a transition of a DC driving scheme to an AC driving scheme. The driving scheme uses two subframes per frame. The display element is DC driven in frame 9 by applying the same voltage, indicative of a display effect, having the same polarity in both subframes 9*a* and 9*b*. Between frame 9 and frame 10 the display control switches from DC driving to AC driving. In subframe 10*a* a voltage level having a certain polarity is applied to the display element; in subframe 10*b* the same voltage level is applied having the opposite polarity. The change of polarity may also occur on the transition from one frame to the next; for example, the polarity may change at the transition from subframe 9*b* to 10*a*, making the voltage in subframe 10*a* have a negative polarity.

The subframes may be used for displaying interframe data. When the change in data is large between subsequent frames, the display controller can form intermediate data or interframe data by interpolating between subsequent frames. The interframe data can be set on the display elements during a subframe. In such an embodiment, the subframes within a frame need not have the same level of applied voltage anymore.

The AC driving scheme can be implemented in the direct drive method as shown in FIG. 2 by causing the display driver 207 to change the polarity of the voltage on the signal lines 218 when moving to the next frame or subframe. The implementation in the active matrix method can be made by changing the polarity of the column signals Vl and Vl+1 in frame p+1 of FIG. 4. As a result, the voltage applied to the display elements M to M+4 will change polarity between frame p and p+1. In another embodiment each frame can be divided into two or more subframes, each subframe applying the same voltage level and a polarity inverted with respect to that of the previous subframe.

When the driving of the display device is to be switched from AC to DC driving, the voltages are no longer applied with alternating polarity but the voltages are applied with the same polarity. When switching from DC driving to AC driving, the voltages will no longer be applied with the same polarity but at least two voltages are applied with changing polarities.

In examples, the selection of a driving scheme for the display element is made in dependence on a characteristic of the data representing the display effect for display by the display element.

The characteristic of the data used for the selection of the driving scheme may be the frame rate of driving a display element or the rate at which new data for display on a display element is input on the input line of the display apparatus. The frame rate is indicative of a rate of consecutively addressing a display element to change a display effect of the display element.

Figure 6:
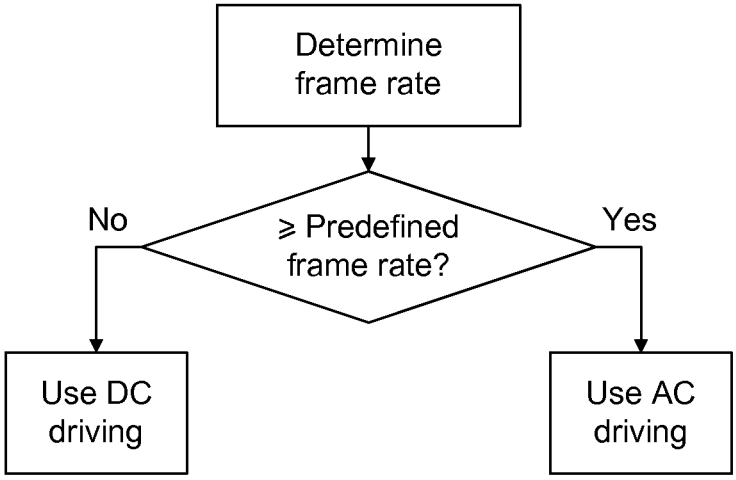
FIG. 6 shows schematically an embodiment of the method.

FIG. 6 shows schematically an example of a so-called DC-AC driving method. Once the frame rate of the data representing the display effect to be displayed has been determined, the DC driving scheme will be used when the frame rate is smaller than a predefined frame rate and the AC driving scheme will be used when the frame rate is larger than or equal to the predefined frame rate. The predefined frame rate may for example be 20 Hz. The selection of the driving scheme may be made in the display controller 206 or 33. It is also possible that the user of the display apparatus can activate a control of the display apparatus and manually set the driving scheme to DC driving for displaying static content, such as pages of a book, and to AC driving for displaying dynamic content, such as a video.

The characteristic of the data used for the selection of the driving scheme may be a difference value, representing a change in display effect between subsequent display effects of a display element. In an implementation using that characteristic, the display controller receives data representing a first display effect and data representing a second display effect for display by a display element. The display controller compares data representing the first display effect and data representing the second display effect and determines a difference value, which is indicative of a change of the display effect of the display element. The selection of the driving method may be based on this difference value. For example, when the changes in display effect are large, the AC driving scheme may be selected and when the changes in display effect are small, the DC driving scheme may be selected.

When driving a display device having a plurality of display elements for displaying images in frames, the change in display effect can be determined for all display elements between two subsequent frames. Two frames may be considered subsequent if one frame follows the other frame and any number of frames, including zero, may be between them. In contrast, two frames may be considered consecutive if one frame follows the other frame immediately, without other frames between them. Data of a first frame representing display effects is stored in the memory 38 of the display controller 33. This data is compared with data of a second, subsequent frame representing display effects, in the processor 37 of the display controller. The difference between the display effects in the two frames can be used as the characteristic used for selecting AC or DC driving. In an example, the selection should be carried out such that AC driving is not used when only a few display elements show a large difference in display effect when most of the display elements change display effect by a small amount.

The difference value indicative of a change in display effects between two frames can be determined in various ways.

The difference value may be determined on the basis of the magnitude of the changes in the display effect between the first and second frame or on relative changes in the display effect between the first and second frame. For example, the display state may be any one of 256 display effects in the form of grey levels, for example display effect intensity levels, numbered from 1 to 256, 1 being a closed state and 256 being a fully open state of the display element. The processor 37 may calculate the magnitude of the change in display effect between two frames for all display elements in a frame. A predefined difference value can be that the display effect changes by more than a predefined change for a predefined number of display elements of the display device. A change from DC to AC driving may be made if the difference value is larger than the predefined difference value, for example 65% of the display elements of the display device change grey level by 60 or more between two frames. A change from AC to DC driving may be made if the difference value is less than the predefined difference value for two frames, or, in this example, the number of display elements that change grey level by 60 or more is less than half of the display elements.

The quantity for selection may also be the number of display elements of which the grey state changes by more than a certain relative amount, for example 40%. A predefined difference value can be that the display effect changes by more than 40% for half of the display elements. If the difference value between the frames is that for example 60% of the display elements change their display effect by more than 40%, a change may be made by choosing an AC driving scheme.

Figure 7:
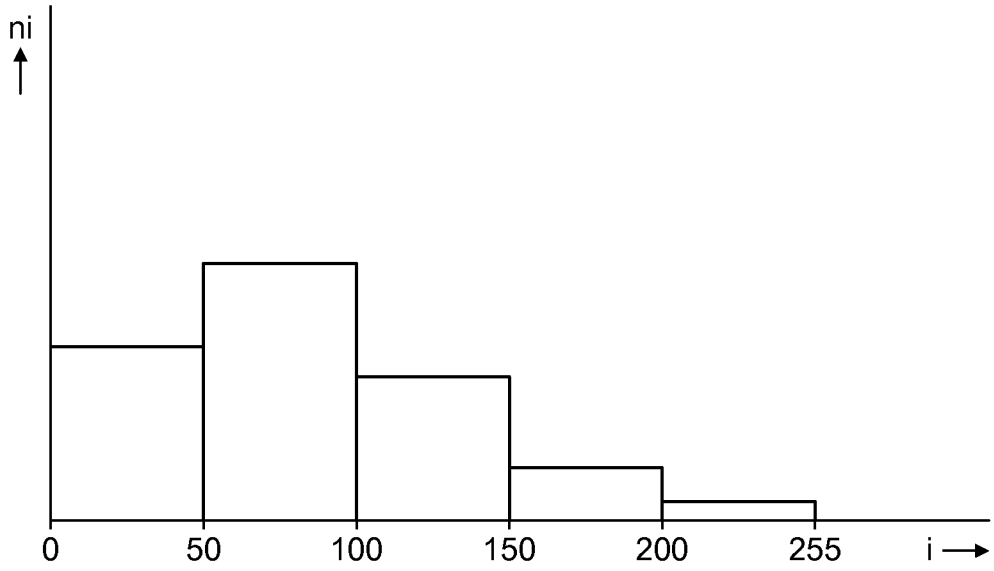
FIG. 7 shows a histogram of change in display effect between two frames.

Another method of determining the difference value is by comparing the display effects a first frame and a second frame for display elements of the display device and arranging the differences between the display effect of a display element in the first frame and in the second frame in a histogram. FIG. 7 shows a histogram of the magnitude of the changes in display effect between two frames. The parameter ni along the vertical axis is the number of display elements of which the display effect changes in a certain range i. The horizontal axis shows five ranges of increasing change of display effect. The actual histogram of changes may be compared with a predefined histogram for determining a difference value to base the selection of driving scheme on. The histogram may also be used to derive statistical parameters, such as average and spread, on which the selection may be based.

The difference value indicative of a change in display effects between two frames may also be expressed in the form of a motion estimate, such as a motion vector. A motion vector represents a change of position of an object in an image between subsequent frames of the image. A motion estimate can be determined by a method such as the block-matching algorithm, phase correlation and frequency domain methods, pixel recursive algorithms and optical flow; these techniques are known. Such a method usually forms a field of motion vectors within the image. The difference value between frames can be expressed as for example the length of the largest motion vector or the average length of the motion vectors in the image.

When the difference value in terms of a motion estimate is below a certain predefined value, the DC driving method may be selected; when the difference value is larger than the predefined value, the AC driving method may be selected.

The above described embodiments of the first class may apply the same driving scheme to all display elements of the display device. It is also possible to drive different parts of the display device with different driving schemes. For example, if part of the image displayed is static and part is dynamic, the dynamic part can be driven using the AC driving scheme and the static part using the DC driving scheme. In a display device of the active matrix type, the dynamic part of the image corresponds to certain rows and certain columns. When these rows are selected, the voltage applied to these columns should apply an alternating voltage, for example as shown in frames 6 to 8 of FIG. 5. The display elements located in the static part of the image are driven as shown in frames 1 and 2 of FIG. 5.

Embodiments of the Second Class

When driving an active matrix display device such as shown in FIG. 3, the display column driver 35 provides voltages on each column signal line 44. FIG. 4 shows by way of example the varying voltages Vl and Vl+1 for columns l and l+1 for display elements on a few consecutive rows. When display elements in adjacent rows and the same column require very different voltages, the driver stage 43 for that column must output a high-frequency signal having a high voltage. This may occur when a checkerboard pattern or a pattern with dark and light squares or squares with different colours, is displayed. It is desirable to reduce the relatively high power consumption.

In accordance with examples to be described, an electrowetting display device may have a plurality of display elements arranged in an active matrix having rows and columns, a specific display element being addressed by applying a voltage to the display elements along the column of the specific display element and selecting the row of the specific display element. The method of driving the electrowetting display device may comprise: determining a first group of rows for which voltages to be applied to display elements in a predefined column or group of columns are within a first range, an extent of the first range being smaller than an extent of a range over which the voltages are controllable; and selecting the rows in the first group consecutively.

Figure 8:
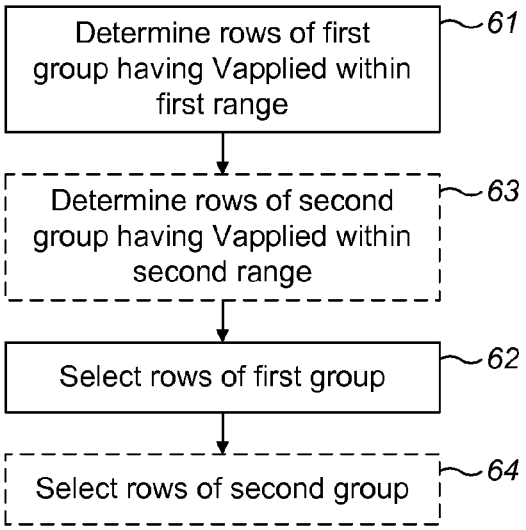
FIG. 8 shows schematically stages of a row-interleave driving method.

FIG. 8 shows schematically stages of a so-called row-interleave driving method. Stages 61 and 62 show the method in the previous paragraph. During the selection of the rows within the first group, the voltage on the column signal line varies only within the first range. Since the number of transitions between high and low voltage are reduced, the power consumption of the column driver 35 is reduced.

Figure 9A:
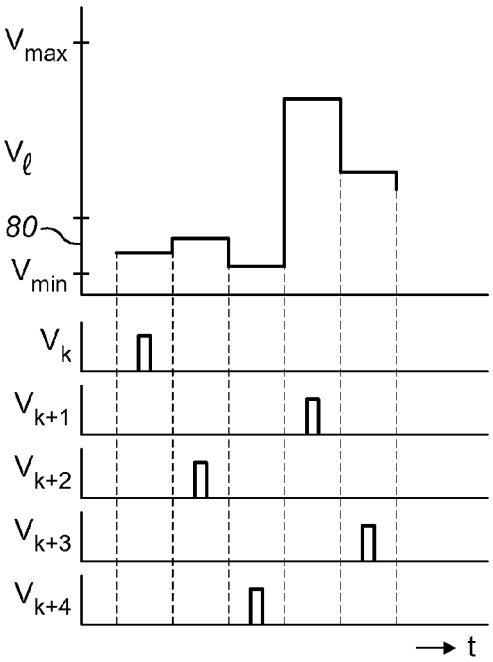
FIGS. 9*a* and 9*c* show diagrams of a row-interleaved driving method.

FIG. 9*a* shows a diagram of voltages versus time within one frame for an embodiment of the row-interleaved driving method. The first stage of the method requires determining a first group of rows where the voltages to be applied in a column are within a first, predefined range. In the example of FIG. 8*a*, display elements m, m+2 and m+4 in column l require a voltage falling within a first range 80. The extent of the first range is smaller than the extent of the voltage range from Vmin till Vmax over which the applied voltage can be controlled. Common values for Vmin and Vmax are 0 and 30 V, respectively. The first range in this example extends from 0 to 5 V and is at the end of the voltage range; that is, an end of the first range coincides with an end of the voltage range. The first range may also extend from 0 to 15V. However, the first range may be located anywhere in the voltage range from Vmin till Vmax. The display elements m, m+2 and m+4 are situated on rows k, k+2 and k+4 (see FIG. 3). These rows therefore belong to the first group.

In the following stage of the method the rows of the first group are selected consecutively. This means that rows not belonging to the group are selected before and/or after selection of the rows of the first group. FIG. 8*a* shows the selection of the rows of the first group by the consecutive pulses for rows k, k+2 and k+4. In this example the other rows, i.e. k+1 and k+3, are selected after the last row (k+4) of the first group has been selected. The voltage on the column signal line 44 of column l varies within the bounds of the first range during selection of the rows in the first group and the power consumption of the column driver 35 will be relatively low. The method is also called the row-interleaved driving method, where the interleaved refers to the changes in timing of selecting the rows.

Figure 9B:
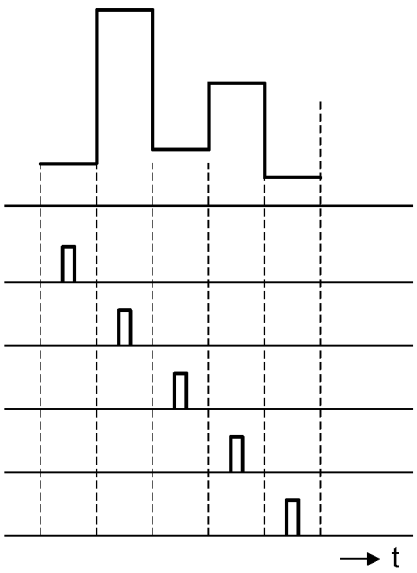
FIG. 9*b* shows a diagram of a non-row-interleaved driving method.

FIG. 9*b* shows the voltage on the column signal line 44 of column l if the row-interleaved driving method is not used and the rows are selected in the order in which they are arranged in the matrix. The same voltages are applied to the five display elements m to m+4 in FIGS. 9*a* and 9*b*. It is apparent that the method of FIG. 9*b* requires substantially more large changes in voltage than the method of FIG. 9*a*. Hence, the power consumption of the column driver 35 is smaller for the method of FIG. 9*a* than for the method of FIG. 9*b*.

Figures 9C, 10A, 10B:
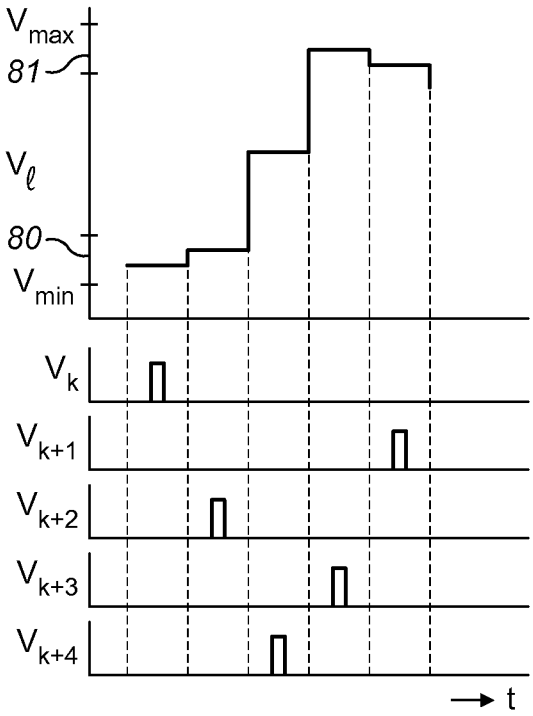
FIGS. 10*a* and 10*b* show a layout of sub-display elements for colour rendering.

FIG. 9*c* shows another embodiment of the row-interleaved driving method, similar to the embodiment of FIG. 9*a*, but wherein a second, predefined range 81 is used. The second range is at the upper end of the voltage range over which the applied voltage is controllable; however, it may be located anywhere in the voltage range from Vmin till Vmax. The first stage of the method requires determining a first group of rows where the voltages to be applied in a column are within the first range and determining a second group of rows where the voltages to be applied in that column are within the second range. In the example of FIG. 8*c*, display elements m and m+2 in column l require a voltage falling within the first range 80 and display elements m+1 and m+3 in column l require a voltage falling within the second range 81. The extent of the second range is smaller than the extent of the voltage range from Vmin till Vmax. The second range in this example extends from 25 to 30 V. Hence, rows k and k+2 belong to the first group and rows k+1 and k+3 belong to the second group.

In the example of FIG. 9*c*, the rows k and k+2 of the first group are selected first, next a row k+4 not belonging to either the first or second group is selected and subsequently the rows k+3 and k+1 are selected. The rows within each group are selected consecutively. The order of the selection within a group may be changed and the order of the groups and other rows may also be changed. The rows may be selected in order of increasing or decreasing applied voltage. The rows may also be selected in the order in which they are arranged in the matrix. The voltage Vl applied to the column signal line 44 as shown in FIG. 9*c* has fewer large changes than for a non-row-interleaved method. The stages of determining the rows belonging to the second group and selecting these rows are shown in FIG. 8 as stages 63 and 64, respectively.

For a display device having a plurality of columns of display elements, the method of determining which rows fall in a first group may be applied for a certain column. The method may also be amended by determining the average of the voltages to be applied to the display elements in each row. The display elements over which the averaging in a row is made, are arranged in a group of columns. This group may include all columns of the display device or a selection of the columns. The rows having an average of the voltages within a first range belong to the first group. Other methods of determining the rows belonging to a group are possible.

Since the data in different frames is often different, the stage of determining the rows of any group may be repeated for each frame.

In a colour display device the display elements may be divided into sub-display elements, each sub-display element designed for displaying a particular colour, for example red, green, blue and white (RGBW). The sub-display elements of a display element may be divided over different rows. Two exemplary layouts are shown in FIGS. 10*a* and 10*b*. FIG. 10*a* shows two display elements 90, each having four sub-display elements distributed over two rows and two columns. The display element 91 in FIG. 10*b* has three sub-display elements distributed over three adjacent rows. If the display device having the layout of FIG. 10*a* displays a uniform magenta colour, e.g. as a background, the R and B sub-display elements will be switched on and the G and W sub-display elements switched off. The voltage for columns l and l+1 will be castellated when the rows are scanned in the order in which they are arranged in the matrix. The row-interleaved driving method will provide a substantially smoother voltage and, hence, lower power consumption of the display column driver 35.

Embodiments of the Third Class

An electrowetting display device can be driven by an analog driving scheme. In an analog driving scheme a voltage is applied to a display element that is indicative of the display effect. Examples of analog driving are AC driving and DC driving. When the data input in the display apparatus requires large and frequent changes of the display effect of an analog-driven display element, the quality of an image displayed is reduced. It is desirable to improve the quality of the images displayed. The embodiments described below improve the quality of the images displayed.

A pulse width modulation (pwm) scheme may use a first voltage during a first period and a second voltage during a second period for driving the display element. The first period may be before the second period and the second period may be before the first period. The first voltage is higher than the second voltage. The durations of the first period and the second period determine the display effect observed. The first voltage may be equal to Vmax and the second voltage equal to Vmin, where Vmax and Vmin are a maximum and a minimum voltage of a voltage range over which the applied voltage can be controlled. Since the movement of the first fluid within the electrowetting cell is faster when driving with large changes in applied voltage, the display element has an improved response to data representing large and frequent changes of the display effect when using pulse width modulation driving compared with using analog driving.

Since analog driving requires less power than pwm driving, a method using an analog driving scheme or a pwm driving scheme depending on the input data requires less power than driving with a pwm driving scheme for all input data.

Figure 11:
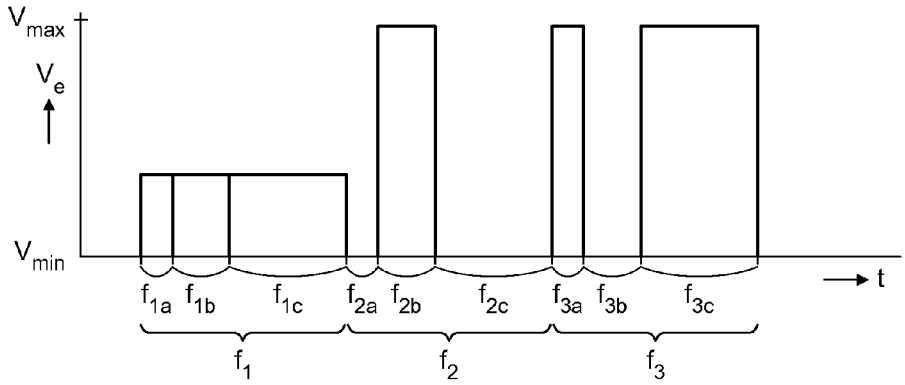
FIG. 11 shows a diagram of an analog-pulse-width modulation driving method.

FIG. 11 shows a diagram of the analog-pwm driving method. It shows the voltage Ve applied to the electrodes of a display element as a function of time for three frames f1 . . . f3. Each frame has three subframes, which are labelled f1*a*, f1*b*, f1*c* for frame f1. The durations of the three subframes are in the ratio 1:2:4. The display elements of the display device are addressed three times during each frame, once for each subframe.

Frame f1 shows an analog driving scheme, in which the voltage Ve is applied to the display element for the duration of the frame. At the start of each subframe in frame f1 the same voltage is applied to the display element. This is an example of DC driving, where all voltages applied to the display element indicative of a display effect have a same polarity. In another example the subframes within a frame have equal length, which may be used for an analog driving scheme and a pwm driving scheme. In an analog driving scheme, a different applied voltage causes a different configuration of the fluids in the display element and, hence, a different display effect. The number of different display effects or grey levels that can be obtained by analog driving depends on the number of voltage levels that can be output by the drivers. A driver may for example be able to output 64 voltage levels, corresponding to 6 bit depth.

Instead of using DC driving, AC driving may also be used, alternating the polarity of the applied voltage, for example between frames or between subframes.

Frames f2 and f3 show a pulse width modulation (pwm) driving scheme. In the first and third subframe f2*a*, f2*c* of f2 the applied voltage is low, and the first fluid in the display element will be covering the entire display area of the display element and the display element will be in an off or closed state. In the second subframe f2*b* of f2 the applied voltage is high, causing the first fluid to contract and showing an open state of the display element. The voltages applied in the pwm scheme are not indicative of the display effect. The display effect depends on the period the first voltage is applied and the period the second voltage is applied.

The display effect in frame f2 is closed during 5/7 of the frame period and open during 2/7 of the frame period. Since the duration of the frame is relatively short, an eye of an observer will average the impression of both states. Hence, frame f2 will show a grey level of 3 on the scale of 1 (closed) to 8 (open). Frame f3 shows a grey level of 6. The three subframes can display 8 grey levels, or a 3 bit depth.

The voltage changes in Ve of FIG. 11 can be implemented in a display apparatus of the direct-drive type by programming the display controller 206 and the display driver 207 in FIG. 2 such that the required voltages are set on the signal lines 5, which are connected to the electrodes of the display elements, the timing corresponding to the subframes in each frame.

The implementation in a display apparatus of the active matrix type provides for addressing of the display elements during the subframes in each frame. The choice of analog or pwm driving can be realized by an appropriate choice of voltages on the column signal lines for the subframes.

The change from analog driving to pulse-width modulation driving and back is made in dependence on a characteristic of the data representing a display effect, input into the display apparatus. The characteristic of the data is similar to the characteristic of embodiments in the first class described above. The characteristic of the data may for example be a frame rate or a difference value. The characteristic may be obtained in the same manner as described above for embodiments of the first class and have similar selection criteria. The determination of the characteristic for a display device having a plurality of display elements may be performed as described above for the first class.

Embodiments of the Fourth Class

An electrowetting display device can be driven by a DC driving scheme. When the data input in the display apparatus requires large and frequent changes of the display effect of display element, the quality of an image displayed is reduced. It is desirable to improve the quality of the images displayed. The embodiments described below improve the quality of the images displayed.

In a method of driving an electrowetting display device has at least one display element for displaying a display effect during a display period. The method may comprise for example receiving data representing a first display effect for display by the at least one display element; and receiving data representing a second display effect for display by the at least one display element subsequent to display of the first display effect. Data representing the first display effect and data representing the second display effect may be compared to determine a difference value indicative of a change of the display effect. A driving scheme for the at least one display element can be selected in dependence on the difference value. The selection can be made from at least a first driving scheme and a second driving scheme. In the first driving scheme a voltage indicative of a display effect is applied to the at least one display element for a first number of times during the display period. In the second driving scheme a voltage indicative of a display effect is applied to the at least one display element for a second number of times during the display period. The second number is different from the first number. The first number may be larger than the second number and the second number may be larger than the first number. The method applies a number of times the voltage indicative of the display effect to the display element or to the electrodes of the display element, where the value of the number depends on the difference value. The number may have any integer value larger than zero.

The method can be configured such that an increasing step in display effect causes a larger number of applications of a voltage to the display element, so the required charge and voltage are attained on the electrodes of the display element.

It has been observed that large and frequent changes of the display effect of a display element may require several applications of a voltage for charging the display element up to the level appropriate for the display effect to be displayed. In the above embodiment, the number of applications of the voltage has been made dependent on the difference value, indicative of a change of the display effect.

Figure 12:
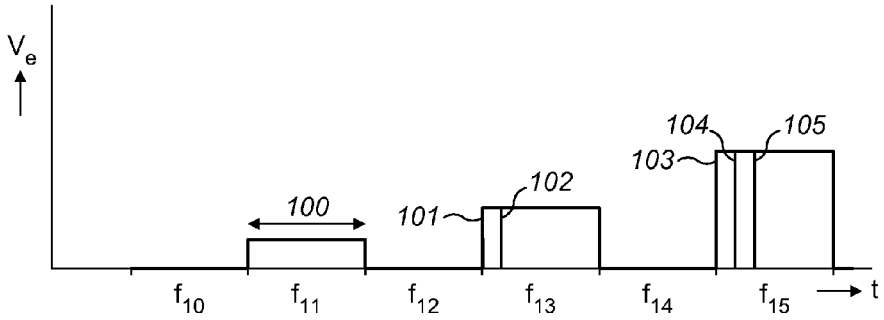
FIG. 12 shows a diagram of a multiple data write driving method.

FIG. 12 shows a diagram of the multiple data write driving method. The voltage Ve applied to the electrodes of a display element is shown as a function of time for six frames f10 . . . f15. A display effect of the display device is displayed during a display period 100, which in this example is the same as the duration or length of a frame.

The change in voltage between frames f10 and f11 is indicative of a display effect of the display element. Hence, the change in applied voltage between frames f10 and f11 is indicative of a change in display effect. The magnitude of the change in display effect can be taken as the difference value between frames f10 and f11. In the example of FIG. 1, the difference value between frames f10 and f11 is smaller than a predefined value and, hence, during frame f11 the display element is driven using the first driving scheme with the first number equal to one.

In the transition from frame f11 to f12 the change in display effect has a different sign than in the transition from frame f10 to f11. These changes can be treated similarly if the difference value is the magnitude of the change of the display effect, making the difference value independent of the sign of the change. Alternatively, the sign can be taken into account, for example by taking into account only positive changes of the display effect.

The transition from frame f12 to f13 shows a relatively large change in display effect. The difference value is now larger than the predefined value and the second driving scheme is selected for frame f13. The value of the second number in this example is two, causing two applications of the voltage during the display period. The first application 101 is at the start of the display period, the second application 102 is after the first application but within the display period. The second and further applications of a voltage are effective when they are grouped near the start of the display period, as shown in FIG. 12.

The still larger change in display state at the transition from frame f14 to frame f15 causes three applications 103, 104, 105 of the voltage to the display element.

The method can be implemented in a display apparatus of the active matrix type by using subframes for each second or further application of the voltage. For example, in frame f13 the display elements of the display device are addressed and the appropriate voltages applied to the column signal lines. Shortly after this addressing action, a subframe causes as next addressing action, applying the same voltages to the column signal lines.

The change from applying the voltage to a display element once or more times in a display period is made in dependence on a difference value, characteristic of the data representing a display effect and which is input into the display apparatus. The difference value is similar to the difference value of embodiments in the first class described above. The difference value may for example be a change of the display effect or a number of display elements of the display device that have a change in display state larger than a predefined change. The predefined change is for example 60 on a grey scale from 1 to 256.

The difference value may be obtained in the same manner as described above for embodiments of the first class and have similar selection criteria. The determination of the characteristic for a display device having a plurality of display elements may be performed as described above for the first class.

The above embodiments are to be understood as illustrative examples. Further embodiments are envisaged. For example, the embodiments may include a driving scheme having a higher frame rate, which may be selected, either separately or in combination with one of the above-mentioned driving schemes. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the accompanying claims.

What is claimed is:

1. A method of driving an electrowetting display device for displaying images, the electrowetting display device having a plurality of display elements arranged in a matrix having columns and n rows, where n is larger than one, a display element of the plurality of display elements being addressable by applying a voltage to a column of the columns, which column comprises the display element, and selecting a row of the n rows, which row comprises the display element, the method comprising:

determining a first group of q rows of the n rows, where q is less than n, for which voltages to be applied to display elements of the plurality of display elements in a predefined column or group of the columns are within a first range, an extent of the first range being smaller than an extent of a range over which the voltages are controllable; and selecting the rows in the first group consecutively.

2. A method according to claim 1, further comprising:

displaying the images in frames; and performing the determining and the selecting for at least one of the frames.

3. A method according to claim 1, in which the display elements of the plurality of display elements are divided in subdisplay elements that are arranged over at least two rows of the n rows.

4. A method according to claim 1, further comprising:

determining a second group of rows of the n rows, different from the first group of q rows, where voltages to be applied to the display elements in the predefined column or group of the columns are within a second range, the second range not overlapping with the first range; and selecting the rows in the second group consecutively.

5. A method according to claim 1, the first range at an end of the range over which the voltages are controllable.

6. A method according to claim 4, the second range at an end of the range over which the voltages are controllable.

7. A method according to claim 4, the first range at an end of the range over which the voltages are controllable and the second range at another end of the range over which the voltages are controllable.

8. A display controller for an electrowetting display device, the display controller comprising at least one processor, at least one memory comprising computer program instructions, and an input of the display controller for data representing images, the electrowetting display device comprising a plurality of display elements arranged in a matrix having columns and n rows, where n is larger than one, a display element of the plurality of display elements being addressable by applying a voltage to a column of the columns, which column comprises the display element, and selecting a row of the n rows, which row comprises the display element, the at least one memory and the computer program instructions being configured to, with the at least one processor, cause the display controller to perform a method of driving the electrowetting display device comprising:

determining a first group of rows of the n rows, where q is less than n, where voltages to be applied to display elements of the plurality of display elements in a predefined column or group of the columns are within a first range, an extent of the first range being smaller than an extent of a range over which the voltages are controllable; and selecting the rows in the first group consecutively.

9. A display controller according to claim 8, configured to:

display the images in frames; and perform the determining and the selecting for at least one of the frames.

10. A display controller according to claim 8, in which the display elements are divided in sub-display elements that are arranged over at least two rows of the n rows.

11. A display controller according to claim 8, configured to perform:

determining a second group of rows of the n rows, different from the first group of q rows, where voltages to be applied to the display elements in the predefined column or group of the columns are within a second range, the second range not overlapping with the first range; and selecting the rows in the second group consecutively.

12. A display controller according to claim 8, the first range at an end of the range over which the voltages are controllable.

13. A display controller according to claim 11, the second range at an end of the range over which the voltages are controllable.

14. A display controller according to claim 11, the first range at an end of the range over which the voltages are controllable and the second range at another end of the range over which the voltages are controllable.

15. An electrowetting display apparatus comprising:

an electrowetting display device comprising a plurality of display elements arranged in a matrix having columns and n rows, where n is larger than one, a display element of the plurality of display elements being addressable by applying a voltage to a column of the columns, which column comprises the display element, and selecting a row of the n rows, which row comprises the display element;

a display driver; and a display controller comprising at least one processor, at least one memory comprising computer program instructions, and an input of the display controller for data representing images, the at least one memory and the computer program instructions being configured to, with the at least one processor, cause the display controller to, using the display driver, perform a method of driving the electrowetting display device comprising:

determining a first group of q rows of the n rows, where q is less than n, for which voltages to be applied to display elements of the plurality of display elements in a predefined column or group of the columns are within a first range, an extent of the first range being smaller than an extent of a range over which the voltages are controllable; and selecting the rows in the first group consecutively.

16. An electrowetting display apparatus according to claim 15, the display controller configured to:

display the images in frames; and perform the determining and the selecting for at least one of the frames.

17. An electrowetting display apparatus according to claim 15, the display elements divided in sub-display elements that are arranged over at least two rows of the n rows.

18. An electrowetting display apparatus according to claim 15, the first range at an end of the range over which the voltages are controllable.

19. An electrowetting display apparatus according to claim 15, the display controller configured to perform:

determining a second group of rows of the n rows, different from the first group of q rows, where voltages to be applied to the display elements in the predefined column or group of the columns are within a second range, the second range not overlapping with the first range; and selecting the rows in the second group consecutively.

20. An electrowetting display apparatus according to claim 19, the second range at an end of the range over which the voltages are controllable.

21. An electrowetting display apparatus according to claim 19, the first range at an end of the range over which the voltages are controllable and the second range at another end of the range over which the voltages are controllable.

22. An electrowetting display apparatus according to claim 1, the selecting the rows in the first group consecutively comprising consecutively switching transistors, each of the transistors connected to a respective row of the q rows, for applying the voltages to the display elements of the plurality of display elements in the predefined column or group of the columns.

* * * * *